United States Patent [19]

Yaghmaie et al.

[11] 4,417,902

[45] Nov. 29, 1983

[54] PROCESS FOR MAKING AND COMPOSITION OF LOW VISCOSITY COAL-WATER SLURRIES

[75] Inventors: Farrokh Yaghmaie, Wappingers Falls; Ronald J. McKeon, Beacon, both of N.Y.

[73] Assignee: Texaco Inc., White Plains, N.Y.

[21] Appl. No.: 413,855

[22] Filed: Sep. 1, 1982

[51] Int. Cl.[3] ..... C10L 1/32

[52] U.S. Cl. ..... 44/51

[58] Field of Search ..... 44/51; 252/356, 357, 252/DIG. 7, 546, 548

[56] References Cited

U.S. PATENT DOCUMENTS 3,712,918 1/1973 Dudzinski et al. ..... 252/356

4,104,035 8/1978 Cole et al. ..... 44/51

*Primary Examiner*—Charles F. Warren

*Assistant Examiner*—Y. Harris-Smith

*Attorney, Agent, or Firm*—Robert A. Kulason; Robert Knox, Jr.; Carl G. Seutter

[57] ABSTRACT

A coal-water slurry having a high solids content and improved pumpability containing a viscosity improving amine additive from the group consisting of substituted 3-amino carboxylic acids, dialkanol alkyl amines or diamines is provided as well as a method of preparation.

16 Claims, No Drawings

PROCESS FOR MAKING AND COMPOSITION OF LOW VISCOSITY COAL-WATER SLURRIES

BACKGROUND OF THE INVENTION

1. Field of the Invention

This invention relates to a process for the improvement of the flow characteristics of slurries of solid fuels in water. More particularly it is concerned with a process for the production of coal water slurries which are made better Bingham plastics by the incorporation therein of a prescribed group of additives as hereinafter more fully described. Thereby reduced viscosities are obtained at high rates of applied shear. This fact in turn is advantageous both by virtue of the savings in pumping energy which are effected as well as by virtue of the longevity which is imparted to the pumping equipment involved.

Most solid carbonaceous fuels, as mined, generally contain varying amounts of water, which in some instances may be as high as 40 wt. % or even higher in the case of low grade solid fuels. This water is an undesirable constituent of the fuel, particularly in the case of fuels of high water content. Thus a slurry containing 50 wt. % water and 50 wt. % solid fuel would contain considerably less than that amount of fuel when the fuel is measured on a dry basis.

The amount of water necessary to form a pumpable slurry depends on the surface characteristics of the solid fuel. For example, soot formed during the partial oxidation of a carbonaceous material has such a high surface area that a concentration of such soot in water in excess of a few wt. % renders the resulting slurry umpumpable. In the case of a slurry which is to be fed to a gas generator, it is necessary that the solid fuel be ground to such an extent that a major portion thereof will pass through a 60 mesh sieve so that the particles are substantially completely converted to oxides of carbon during their short residence time within the gasification zone. However, ordinarily before reaching the gasification zone the slurry must pass through various pieces of equipment such as heat exchangers and compressors on its way from the slurry zone to the gas generation zone. Accordingly the slurry must be pumpable but in the case of a slurry made up of solid fuel particles most of which will pass through a 200 mesh sieve it has been found that ordinarily, a pumpable slurry must contain from about 55 to 60 wt. % water. Unfortunately a slurry containing this amount of water renders the operation of the gasifier unsatisfactory as this excessive amount of water moderates the temperature of the reaction zone to such an extent that it seriously affects its thermal efficiency. It has been found that the optimum amount of water in a solid fuel-water slurry which may be used as feed to a gas generation zone will lie from between 40 and 50 wt. %. A water content of 30 wt. % would be even more preferable, if it could be achieved.

It is therefore an object of this invention to produce solid fuel water slurries having a relatively high solids content. Still another object of the invention is to produce pumpable slurries of solid fuel in water wherein the bulk of the solid fuel will pass through a sieve as fine as 60 mesh and in which the water content of the slurry will range between about 40 and 50 wt. %. Yet another object of the invention is to produce an improved Bingham plastic slurry, which by definition is handled with lower expenditure of energy as a result of lowered viscosity at high shear rates which may be expected at high rates of flow. Yet another object of the invention is to extend the useful life of pumping equipment by lowering the viscosity of the slurries pumped when operating at customary shear rates. These and other objects will become apparent on further reading of this specification.

2. Description of the Prior Art

U.S. Pat. No. 3,210,168 discloses the use of an imidazoline surfactant to stabilize a dispersion of pulverized coal coated with a liquid hydrocarbon fuel in about 15 to 20% by weight of water.

U.S. Pat. No. 3,907,134 discloses the use of detergents, lignin liquors or amino acids as viscosity reducing agents for incorporation in fuel-water slurries comprising a solid particulate carbonaceous material and a liquid hydrocarbon fuel that also contains a slurry suspension stabilization agent such as starch.

U.S. Pat. No. 4,088,453 discloses the use of between about 0.1 and 5.0 wt. % of ammonia to improve the pumpability of a solid fuel-water slurry by reducing the slurry viscosity.

Japanese patent application Derwent Accession No. 61415A discloses the use of one or more bisamides of the general formula $$R_1CONH—R_3—N(R_5)—R_4—NHCOR_2$$

wherein both $R_1$ and $R_2$ are $C_{11}$ alkyl or alkenyl groups, both $R_3$ and $R_4$ are $C_2$–$C_4$ alkyl groups and $R_5$ is H or a $C_1$–$C_4$ alkyl group, as an emulsifier for coal oil based mixed fuel slurries.

Japanese patent application, Derwent Accession No. 61418A discloses the use of one or more ether amine derivatives of the general formula $$ROCH_2CH_2CH_2N\begin{matrix}(CH_2CH_2O)_nH \\ (CH_2CH_2O)_mH\end{matrix}$$

wherein R is a greater than $C_8$ alkyl or alkenyl group, m and n are integers in the range between 0 to 20 and the sum of m+n is less than 30.

A further Japanese patent application, Derwent Accession No. 55787A discloses the use of a compound related to the one mentioned in the preceding paragraph or a salt thereof wherein the alkyl ether group attached to the amino group is a $C_{12+}$ alkyl or alkenyl group, m and n are integers in the range from 0 to 20 and the sum thereof is 1–30.

SUMMARY OF THE INVENTION

According to this invention there is provided a process for improving the pumpability of a solid fuel-water slurry which comprises adding to said slurry one of a specific group of primary, secondary and tertiary water soluble amino compounds as hereinafter more fully described in amounts ranging up to about 5 wt. % preferably 1 wt. % based on the total weight of the slurry. Such slurry ordinarily contains from about 40 wt. % to about 70 wt. % of solid fuel.

Said expression "water soluble amino compounds" as used in this specification and the accompanying claims is intended to cover a water soluble amino compound selected from the group consisting essentially of N,N-monoalkyl-3-amino butanoic acids (or the corresponding primary amines), N,N-(dialkanol) alkyl amines, and N,N-(dialkyl)-omega-amino alkyl amines (or the corresponding primary amines) wherein in said last mentioned family of compounds the respective hydrocarbon groups contain carbon atom chains varying in length from $C_2$ to $C_{20}$. However none of the respective molecules as a whole contain more than 24 carbon atoms, irrespective of which one of the foregoing three families of compounds to which they may belong.

Any solid fuel such as anthracite, bituminous coal, sub-bituminous coal, coke and lignite may be used in the process of this invention although it is more particularly adapted to the treatment of the lower grade fuels such as sub-bituminous coal and lignite. The solid fuel should be in finely-divided form so that at least about 50 wt. %, preferably about 70–80 wt. % passes through a 60 mesh sieve (U.S. standard).

DETAILED DESCRIPTION OF THE INVENTION

Our invention is believed to operate as a result of adsorption of the hydrocarbon groups of our additives on the free surfaces of the slurried coal particles. The polar attachments of our additives then tend to impart a charged outer surface to such coal particles. As a result, such particles repel each other resulting in a stable colloid and the stability of such slurry is further aided by solvation of the exposed polar groups by the surrounding water molecules which are themselves highly polar.

Insofar as viscosity reduction is concerned, it should be noted that a Bingham plastic fluid is ordinarily not a liquid but a suspension, as is a coal-water slurry. This with a loose agglomeration of suspended particles at low shear rates there is considerable inter-particle friction leading to a high viscosity. With increasing applied shear rates there is a break down of such particle agglomeration with consequent decreased internal friction and reduced viscosity. Naturally, at certain high shear rates, the particle separation reaches its practical maximum with the corresponding minimal, asymptotic viscosity. Moreover, at extraordinarily high shear rates, some separation of the particles from the medium due to centrifugal action may occur, thereby adversely affecting the homogeneity of the slurry. Carbon particle separation is therefore achieved ordinarily with mechanical agitation alone as a result of an externally applied shear stress. However, said separation is greatly enhanced by the additives of our invention causing electrostatic repulsion between carbon particles following the adsorption of such additives on such carbon particles. A minimal or asymptotic viscosity is reached quicker with the assistance of said additives.

In any given situation the preferred embodiment of our invention, as contemplated by us will depend on the available adsorption surface area of the pulverized coal which is to be slurried as has already been noted above.

The available adsorption surface area depends upon numerous factors such as the maximum and minimum particle sizes and size distribution in any given sample of pulverized coal, the rank of the coal, unavailability of portions of the free surface area as a result of oxidation, slag particles and the like. Determination of the available surface area and the consequent computation of an effective amount of the additives of our invention to utilize all or nearly all of such area will be readily apparent to persons of ordinary skill in the art to which our invention pertains.

However an excess of the additives of our invention must be avoided. Such excess additive molecules which are not adsorbed may reduce the specific gravity of the aqueous medium and the resulting decreased differential in specific gravities between the aqueous and solid media will in turn lead to increased difficulties in maintaining the coal-water slurry as a stable suspension. Also, at higher concentrations other competing processes such as micelle formation of our additive molecules can occur, which could reduce the number of additive molecules available to be adsorbed upon the coal surfaces. The optimal amount of our additives needed will be determined by such factors as coal particle size and available surface area and the other factors discussed above.

Being mindful of the uncertainties caused by the nature of the coal utilized and the degree of its comminution (and particle size distribution), we contemplate in the preferred embodiment of our invention, the use of no more than about 5 wt. % (based on the total weight of the slurry as a whole) of one of our additives in an aqueous slurry containing more than about 50 wt. % slurried coal particles.

In practice of our invention it is preferred also that our additives be employed at the grinding mill stage during wet grinding before the addition of further water while pulverizing the coal for two reasons, as follows.

First the additives serve as grinding aids by maintaining a low slurry viscosity during grinding.

Second, the additives are immediately available for adsorption on the new surfaces generated during comminution of the coal. Accordingly, need for later treatment is minimized or eliminated and saves time, energy, and materials cost. The following is a description of the methods of carrying out the present invention.

EXAMPLE I

A coal-water slurry was prepared by mixing with stirring 45.71% by weight of a sub-bituminous coal from the Lake De Smet region that had been previously ground to pass through the openings of a 60 mesh screen (U.S. Standard). The water component was distilled water to which there had been added an N,N-monoalkyl-3-amino butanoic acid as an additive in such amount that after initial mixing a coal-water slurry containing 1 wt. % of said additive was formed. The additive actually used by us consisted of a uniform mixture of all homologs of such compound wherein the alkyl group was a hydrocarbon radical of from $C_{10}$ to $C_{18}$. It should be understood that in practice, a non-uniform mixture of such homologs or even a pure homolog may be effectively used without departing from the spirit of our invention.

The viscosity of the resulting additive containing coal-water slurry was determined at a number of shear rates using a drag viscometer. The results are set forth in the Table below.

EXAMPLES II—III INCLUSIVE

Following the procedure of Example I above further additive-containing, coal-water slurries were prepared using 53.05 and 56.03 wt. % respectively of the ground coal with the same additive as in Example I. The viscosities of these slurries were also determined and the results reported in the Table below.

EXAMPLE IV

Following the procedure of Example I, another additive-containing, coal-water slurry containing 51.25 wt. % of coal was prepared using 1% by weight of a dialkanol alkyl amine. The additive actually used by us consisted of a uniform mixture of all homologs of such compound wherein the alkanol radical was —$CH_2CH_2OH$ and the alkyl group was a hydrocarbon radical of from $C_{10}$ to $C_{20}$. It should be understood that in practice a non-uniform mixture of such homologs or even a pure homolog may be effectively used without departing from the spirit of our invention. Viscosity measurements of this additive coal-water slurry were taken and are set forth in the Table below.

EXAMPLES V-VI INCLUSIVE

Following the procedure of Example I above, further additive containing, coal-water slurries were prepared using 51.72 and 55.18 wt. % respectively of the ground coal and also using N,N-(diethyl)-3-amino propyl amine as an additive. The viscosities of these slurries were determined and the resulting readings are set forth in the Table below.

EXAMPLE VII

Following the procedure of Example I above, a further additive containing, coal-water slurry containing 48.26 wt. % of ground coal was prepared using ethylene diamine as an additive. The viscosity of the resulting slurry was measured at varying shear rates and the readings obtained are set forth in the Table below.

CONTROL EXAMPLES A AND B

Viscosity measurements of coal-water slurries prepared as in Example I, containing 47.89 wt. % and 52.80 wt. % of coal, respectively, without any additive, were determined and are set forth in the Table.

CONTROL EXAMPLES C AND D

Example I was repeated using as an additive, 1% by weight of a known coal-water slurry viscosity reducing agent, namely, ammonium lignin sulfonate. The coal concentrations were 45.04 wt. % and 52.60 wt. % respectively. Viscosity measurements obtained on these resulting additive containing coal-water slurries were taken and are set forth in the following table.

TABLE

| COAL CONCENTRATION (PERCENT) | | Wt. % SURFACTANT USED | SHEAR RATE (Sec.$^{-1}$) 5.1 | 10.2 | 170 | 340 | 510 | 1020 |
|---|---|---|---|---|---|---|---|---|
| | | | VISCOSITY (POISES) | | | | | |
| Example I | 46.71 | 1% N,N—monoalkyl-3-amino butanoic acid | 5 | 2.75 | 0.60 | 0.51 | 0.42 | 0.34 |
| II | 53.05 | 1% N,N—monoalkyl-3-amino butanoic acid | 8.5 | 4.50 | 1.69 | 1.36 | 1.21 | 0.91 |
| III | 56.03 | 1% N,N—monoalkyl-3-amino butanoic acid | 15.25 | 8.25 | 2.06 | 1.59 | 1.37 | 1.01 |
| IV | 51.25 | 1% diethanol alkyl amine | 16 | 8.5 | 2.53 | 2.03 | 1.78 | 1.46 |
| V | 51.72 | 1.7% N,N—(diethyl)-3-amino propyl amine | —* | —* | 1.49 | 1.30 | 1.22 | 0.98 |
| VI | 55.18 | 1.7% | —* | —* | 2.34 | 1.79 | 1.60 | 1.17 |
| VII | 48.26 | 1% ethylene diamine | 8.0 | 7.0 | 0.77 | 0.52 | 0.45 | 0.32 |
| Control Example A | 47.89 | 0 | 10.5 | 6.62 | 1.17 | 0.83 | 0.75 | 0.67 |
| B | 52.80 | 0 | 26.16 | 14.66 | 2.94 | 2.36 | 2.09 | —* |
| C | 45.04 | 1% Ammonium Lignin Sulfonate | 2.25 | 1.81 | 0.73 | 0.66 | 0.83 | 0.73 |
| D | 52.60 | 1% Ammonium Lignin Sulfonate | 9.5 | 6.25 | 1.87 | 1.62 | 2.05 | —* |

*No viscosity measurements are noted in these blank spaces because no reliable viscosity measurements were obtainable.

Inspection of the data in the above table shows that the additive containing slurries of the present invention (Examples I–VII) were particularly effective in reducing the respective viscosities of coal-water slurries, especially at the higher shear rates, e.g., between 170 and 1020 sec.$^{-1}$.

In contrast, the control Examples A and B, containing no additive, had considerably higher viscosities at these same shear rates. The only instances where the control examples showed a lower viscosity were where the coal concentration was lower.

For example, control Example A showed lower viscosity at the shear rates between 170 sec.$^{-1}$ and 1020 sec.$^{-1}$ than was the case with Examples II, III, IV, V and VI.

However, it should also be noted that the coal content of the slurries of Examples II,III,IV, and VI were higher than that of control Example A by roughly 3 to 8 percent.

In contrast, where the coal contents of the slurries being compared were roughly equal, as in Example VII and Control Example A there was a remarkable reduction in the viscosity of the additive containing slurry at the higher shear rate of 170 sec.$^{-1}$ to 1020 sec$^{-1}$.

Control Examples C and D, containing the known viscosity reducing additive, ammonium lignin sulfonate, show that this additive was not as effective as the additives of the present invention. The corresponding viscosities obtained using this known additive were somewhat higher, ranging from 0.66, 0.83 and 0.73 poises at the 340 sec.$^{-1}$, 510. sec.$^{-1}$ and 1020 sec.$^{-1}$ respective shear rates for a coal concentration of 45.04% whereas with a higher coal concentration of 46.71% our Example I showed only a viscosity of 0.51, 0.42 and 0.34 poises respectively at these same shear rates.

From the above data it is now apparent that the use of the prescribed group of water soluble amino compound additives as viscosity reducing agents in carbonaceous solid fuel-water slurries have the added advantage of rendering such slurries Bingham plastic fluids whereas in the absence of such an additive the coal-water slurry is a Bingham plastic only up to a certain rate of shear and then becomes dilatant.

Moreover, as described, one can increase the coal content of the slurry and achieve the processing of greater quantities of slurried fuel by using the additives of our invention.

Various modifications of the invention as hereinbefore set forth may be made without departing from the spirit and scope thereof, and therefore, only such limitations should be made as are indicated in the appended claims.

We claim:

1. An aqueous slurry of a comminuted solid fuel having improved pumpability properties which comprises from about 50 to 70 weight percent of an 8 to 200 mesh comminuted fuel, from about 50 to 30 weight percent water and from about 0.01 to 5 weight percent of a compound selected from the group consisting of:

(a) a beta substituted carboxylic acid represented by the formula:

$$R_1-CH_2-\underset{\underset{NHR_2}{|}}{CH}-CH_2-COOH$$

wherein $R_1$ and $R_2$ each represent hydrogen or a hydrocarbon radical containing from 1 to 20 carbon atoms provided that $R_1$ and $R_2$ together contain no more than 20 carbon atoms:

(b) a dialkanol alkyl amine represented by the formula $$(HO-CH_2-CH_2)_2=N-R_3$$

wherein $R_3$ is hydrogen or a hydrocarbon chain having from 1 to 20 carbon atoms; and (c) a diamine represented by the formula $$NH_2-R_4-NR_5R_6$$

wherein $R_4$ is a divalent hydrocarbon radical having from 2 to 20 carbon atoms and $R_5$ and $R_6$ each represent a hydrocarbon radical having from 2 to 20 carbon atoms with the proviso that the sum of the carbon atoms in $R_4$, $R_5$ and $R_6$ does not exceed 24.

2. The process of claim 1 in which the solid fuel is a coal selected from the group consisting of lignite, subbituminous, bituminous and anthracite coals.

3. The process of claim 1 in which the selected compound is added in an amount between about 0.2 and about 3.0 wt. %.

4. The process of claim 1 in which at least 50% of the solid fuel passes through a 200 mesh sieve.

5. The process of claim 1 in which at least 80% of the solid fuel passes through a 200 mesh sieve.

6. The process of claim 1 in which all of the solid fuel passes through a 60 mesh sieve.

7. The process of claim 1 in which the slurry contains between about 50 and about 60 wt. % solid fuel measured on a dry basis.

8. A process for making the pumpable comminuted solid fuel-water slurry of claim 1 which comprises adding from about 0.01 to about 5.0 weight percent of a member of said group of compounds based on the resulting solid fuel-water slurry as a whole to solid carbonaceous fuel prior to or simultaneously with addition of a minor portion of water; comminuting said solid fuel to the extent that all of it passes through a sieve no more coarse than 60 mesh and adding a major portion of water to said comminuted solid carbonaceous fuel and compound in sufficient amount to comprise in toto from about 30 to about 50 weight percent of the resulting solid fuel-water slurry as a whole.

9. An aqueous slurry of a comminuted solid fuel having improved pumpability properties which comprises from about 50 to about 70 weight percent of an 8 to 200 mesh comminuted fuel, from about 50 to 30 weight percent water and from about 0.01 to 5 weight percent of a compound selected from the group consisting of:

$$CH_3-\underset{\underset{NHR_7}{|}}{CH_2}-CH_2-COOH, \qquad (a)$$

wherein $R_7$ is a hydrocarbon chain containing from 10 to 18 carbon atoms, $$(HO-CH_2-CH_2)_2=NR_8 \qquad (b)$$

wherein $R_8$ is a hydrocarbon chain containing from 10 to 20 carbon atoms, $$NH_2-CH_2-CH_2-CH_2-N=(CH_2-CH_3)_2 \qquad (c)$$

and $$NH_2-CH_2-CH_2-NH_2 \qquad (d)$$

10. The process of claim 9 in which the solid fuel is a coal selected from the group consisting of lignite, subbituminous, bituminous and anthracite coals.

11. The process of claim 9 in which the selected compound is added in an amount between about 0.2 and about 3.0 wt. %.

12. The process of claim 9 in which at least 50% of the solid fuel passes through a 200 mesh sieve.

13. The process of claim 12 in which at least 80% of the solid fuel passes through a 200 mesh sieve.

14. The process of claim 9 in which all of the solid fuel passes through a 60 mesh sieve.

15. The process of claim 9 in which the slurry contains between about 50 and about 60 wt. % solid fuel measured on a dry basis.

16. A process for making the pumpable comminuted solid fuel-water slurry of claim 9 which comprises adding from about 0.01 to about 5.0 weight percent of a member of said group of compounds based on the resulting solid fuel-water slurry as a whole to solid carbonaceous fuel prior to or simultaneously with addition of a minor portion of water; comminuting said solid fuel to the extent that all of it passes through a sieve no more coarse than 60 mesh and adding a major portion of water to said comminuted solid carbonaceous fuel and compound in sufficient amount to comprise in toto from about 30 to about 50 weight percent of the resulting solid fuel-water slurry as a whole.

* * * * *